US008118947B2

(12) United States Patent
Haeberle

(10) Patent No.: US 8,118,947 B2
(45) Date of Patent: Feb. 21, 2012

(54) SEALING DEVICE FOR A DISHWASHER, AND ASSOCIATED APPARATUS AND METHOD

(75) Inventor: Robert Haeberle, New Bern, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 385 days.

(21) Appl. No.: 12/123,804

(22) Filed: May 20, 2008

(65) Prior Publication Data

US 2009/0288690 A1 Nov. 26, 2009

(51) Int. Cl.
*B08B 3/00* (2006.01)

(52) U.S. Cl. ..... 134/56 D

(58) Field of Classification Search ..... 134/56 D
See application file for complete search history.

(56) References Cited

U.S. PATENT DOCUMENTS

| | | | | |
|---|---|---|---|---|
| 3,276,783 | A * | 10/1966 | McKinven, Jr. | 277/562 |
| 3,732,835 | A | 5/1973 | Long | |
| 3,837,120 | A | 9/1974 | Hanks et al. | |
| 4,608,780 | A | 9/1986 | Van Noy | |
| 5,031,651 | A | 7/1991 | Spiegel et al. | |
| 6,076,835 | A * | 6/2000 | Ress et al. | 277/637 |
| 6,536,451 | B2 | 3/2003 | Hechtl et al. | |
| 6,817,367 | B2 | 11/2004 | Flowers et al. | |
| 2003/0041523 | A1 | 3/2003 | Kiesler et al. | |
| 2003/0182732 | A1 * | 10/2003 | Davenet et al. | 8/158 |
| 2003/0230955 | A1 | 12/2003 | Welch | |
| 2004/0177869 | A1 | 9/2004 | Flowers et al. | |
| 2007/0181168 | A1 | 8/2007 | Oppel et al. | |

FOREIGN PATENT DOCUMENTS

| | | | |
|---|---|---|---|
| DE | 7531758 | * | 2/1975 |
| GB | 2130479 | * | 6/1984 |
| GB | 2201886 | * | 9/1988 |

OTHER PUBLICATIONS

Machine translation of DE7531758 (Feb. 1975).*

* cited by examiner

*Primary Examiner* — Michael Barr
*Assistant Examiner* — David Cormier
(74) *Attorney, Agent, or Firm* — Alston & Bird LLP

(57) ABSTRACT

A sealing device for a dishwasher is provided, comprising at least one flange member. Each flange member is adapted to interact with at least one of a gasket member, a tub portion, and a door member. Each flange member is configured to extend along at least one opposing side of a front opening of the tub portion. Each flange member is cantilevered so as to extend between each opposing side of the front opening of the tub portion and the door member, upon closing thereof, so as to deflect washing fluid within the tub portion away from the gasket member forming a seal between the door member and the tub portion. An associated apparatus and method are also provided.

10 Claims, 7 Drawing Sheets

SEALING DEVICE FOR A DISHWASHER, AND ASSOCIATED APPARATUS AND METHOD

BACKGROUND OF THE INVENTION

1. Field of the Invention

The present invention relates to dishwashers and, more particularly, to a sealing device for a dishwasher, and associated apparatus and method.

2. Description of Related Art

A dishwasher generally includes a tub having a forward-facing vertical opening, wherein a door is engaged with the tub so as to be pivotable about the lower end of the tub and to close the tub opening during the washing process. The tub is only partially filled with wash water during the washing process. In such instances, the limited amount of water is re-circulated by a circulation pump through the wash arms of the dishwasher and over the dishware to clean the dishware within the tub. However, because of the manner in which the wash water is re-circulated, the wash water may splash onto or otherwise contact many components within the tub, including any seals configured to retain the water within the tub. As such, there may be opportunities for water leaks to occur. For example, the tub may include a "tub dam" about the lower end of the tub opening to provide a "dam" for containing a particular level of the wash water within the tub. Leakage may sometimes occur by the wash water flowing over the "dam" as evidenced by a leak on the floor in front of the dishwasher unit. In another example, the wash water re-circulated through the wash arms may splash against or otherwise flow toward the seal between the front opening of the tub and the closed door, thereby providing further opportunity for leakage.

Thus, there exists a need for an apparatus and method to prevent water from escaping/leaking from a dishwasher, so as to reduce the risk of water damage due to such leaks and to reduce or minimize service calls that result therefrom. Such a method and apparatus should be relatively simple, readily implemented, cost effective, and capable of being retrofitted to existing dishwasher units.

BRIEF SUMMARY OF THE INVENTION

The above and other needs are met by the present invention which, in one embodiment, provides a sealing device for a dishwasher. Such a sealing device comprises at least one flange member, with each flange member being adapted to interact with at least one of a gasket member, a tub portion, and a door member. Each flange member is configured to extend along at least one of the opposing sides of a front opening of the tub portion. Each flange member is cantilevered with respect to the at least one of the gasket member, the tub portion, and the door member, so as to extend between each opposing side of the front opening of the tub portion and the door member, upon closing thereof, so as to separate the tub portion from the seal and to deflect washing fluid within the tub portion away from the gasket member forming the seal between the door member and the tub portion.

Another aspect of the present invention provides a dishwasher comprising a tub portion defining a front opening for receiving dishware therethrough, the front opening having opposing sides. A door member is pivotably engaged at the lower end of the tub portion for selectively allowing access to the tub portion through the front opening. A gasket member is configured to be received in operable engagement with one of the tub portion and the door member along the opposing sides of the front opening. The gasket member is configured to interact with the other of the tub portion and the door member to form a seal therebetween when the door member is pivoted to a closed position with respect to the front opening. The dishwasher further comprises at least one flange member, with each flange member being configured to interact with at least one of the gasket member, the tub portion about the opposing sides, and the door member about the opposing sides. Each flange member is configured to extend along at least one opposing side of the front opening of the tub portion. Each flange member is cantilevered with respect to the at least one of the gasket member, the tub portion about the opposing sides, and the door member about the opposing sides, so as to extend between each opposing side of the front opening of the tub portion and the door member, upon closing thereof, so as to separate the tub portion from the seal and to deflect washing fluid within the tub portion away from the gasket member forming the seal between the door member and the tub portion.

Yet another aspect of the present invention comprises a method of sealing a dishwasher appliance, wherein the dishwasher appliance includes a tub portion defining a front opening therethrough into the tub portion. The dishwasher appliance further includes a door member pivotably engaged with a lower end of the tub portion for selectively allowing access to the tub portion. At least one of the door member and the tub portion is adapted to receive a gasket member in operable engagement therewith about the front opening, with the gasket member extending along opposing sides of one of the door member and the tub portion, about the front opening of the tub portion, and being adapted to interact with the other of the door member and the tub portion to form a seal therebetween. Such a method comprises operably engaging a flange member with at least one of the gasket member, the tub portion about the opposing sides, and the door member about the opposing sides so as to extend between each opposing side of the front opening of the tub portion and the door member, upon closing thereof, such that the flange member separates the tub portion from the seal and deflects washing fluid within the tub portion away from the gasket member forming the seal between the door member and the tub portion.

Embodiments of the present invention thus provide significant advantages as disclosed herein in further detail.

BRIEF DESCRIPTION OF THE SEVERAL VIEWS OF THE DRAWING(S)

Having thus described the invention in general terms, reference will now be made to the accompanying drawings, which are not necessarily drawn to scale and which do not necessarily illustrate actual geometries, and wherein:

FIGS. 1 and 2 schematically illustrate perspective views of a prior art apparatus adapted to be implemented within a dishwasher appliance;

FIGS. 3 and 4 schematically illustrate cross-sectional perspective views of the prior art apparatus of FIG. 1 implemented within a dishwasher appliance;

FIG. 5 schematically illustrates a cross-sectional perspective view of a dishwasher appliance implementing a deflector member according to one embodiment of the present invention;

FIG. 6 schematically illustrates a perspective view of a tub portion of a dishwasher appliance implementing a deflector member according to one embodiment of the present invention;

FIG. 7 schematically illustrates a cross-sectional plan view of a dishwasher appliance implementing a deflector member according to one embodiment of the present invention;

Figure 1:
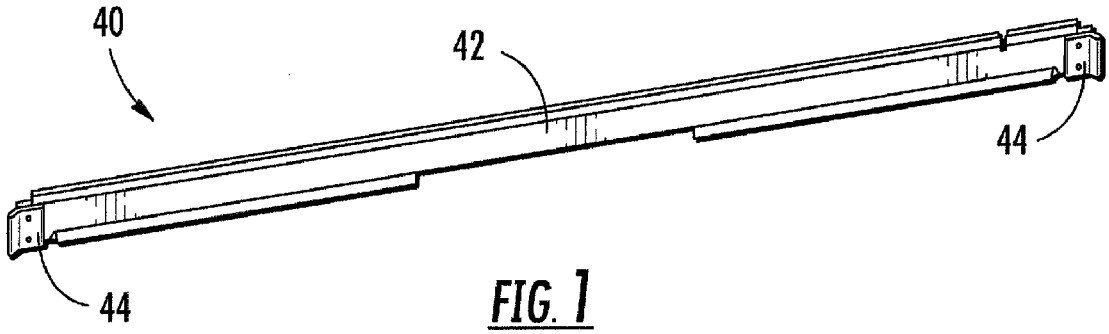
FIG. 1 PRIOR ART
Figure 2:
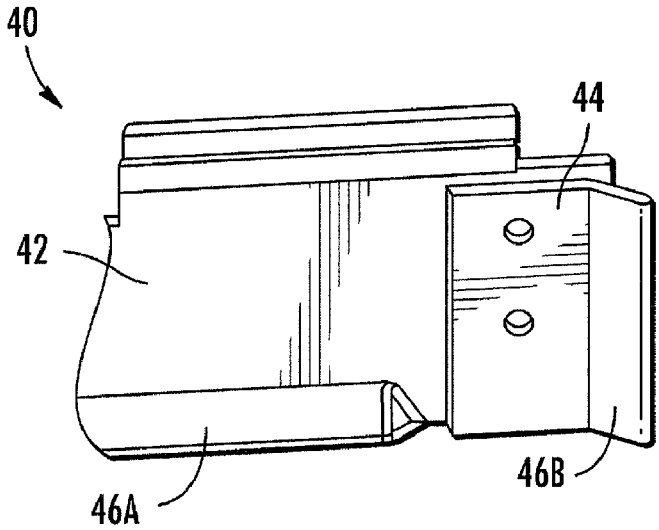
FIG. 2 PRIOR ART
Figure 3:
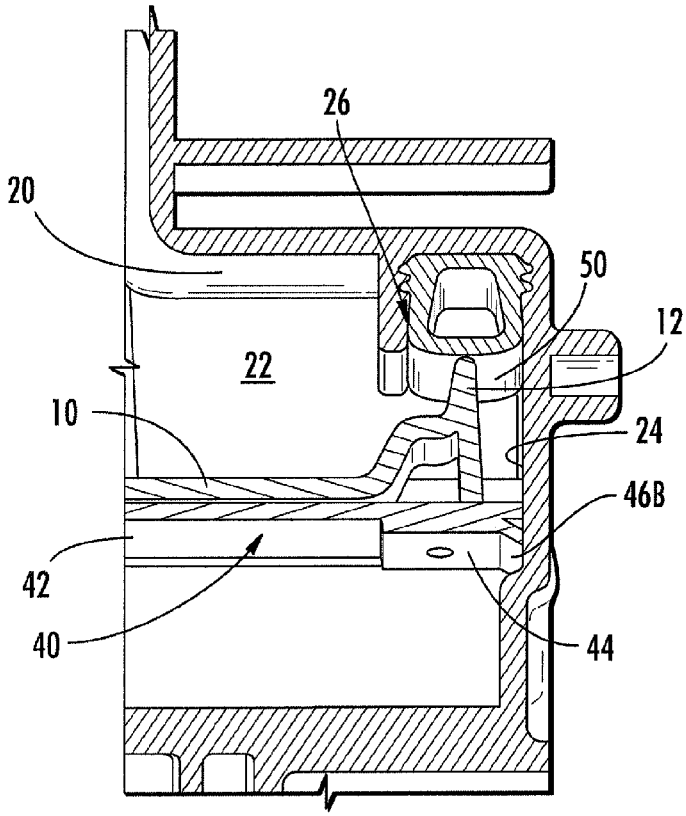
FIG. 3 PRIOR ART
Figure 4:
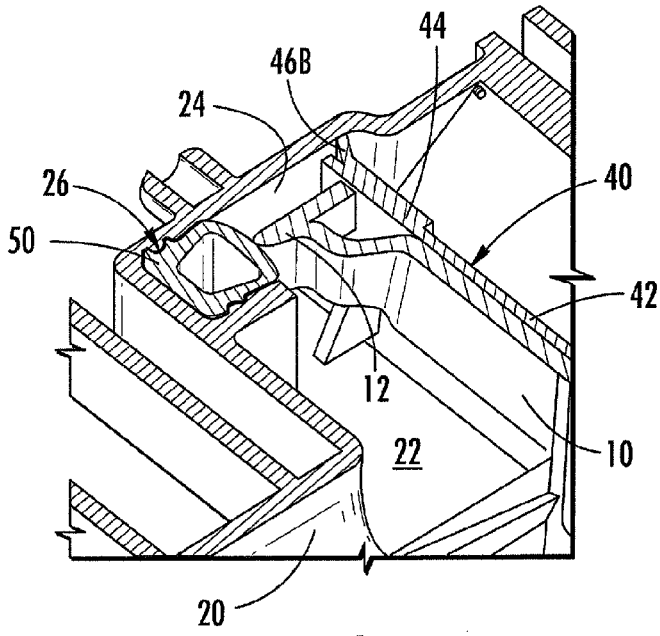
FIG. 4 PRIOR ART
Figure 5:
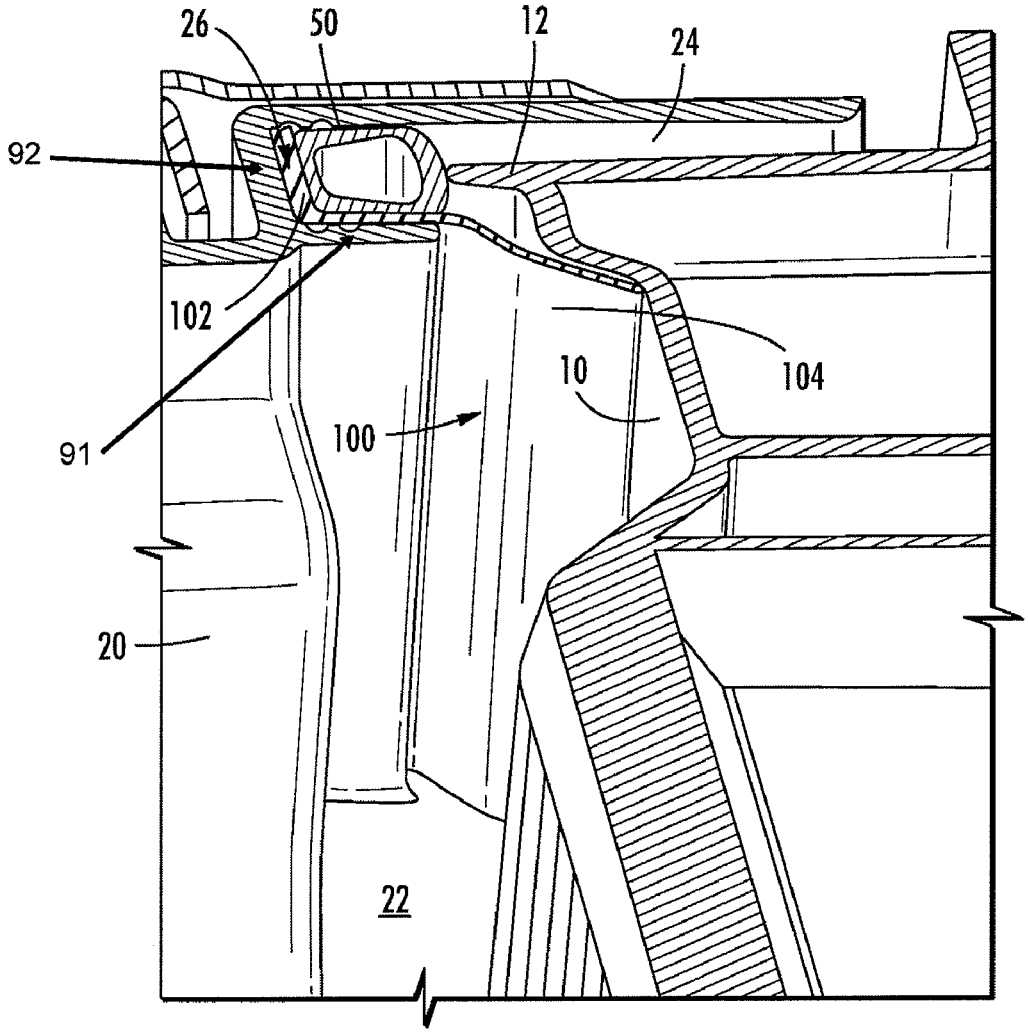
Figure 6:
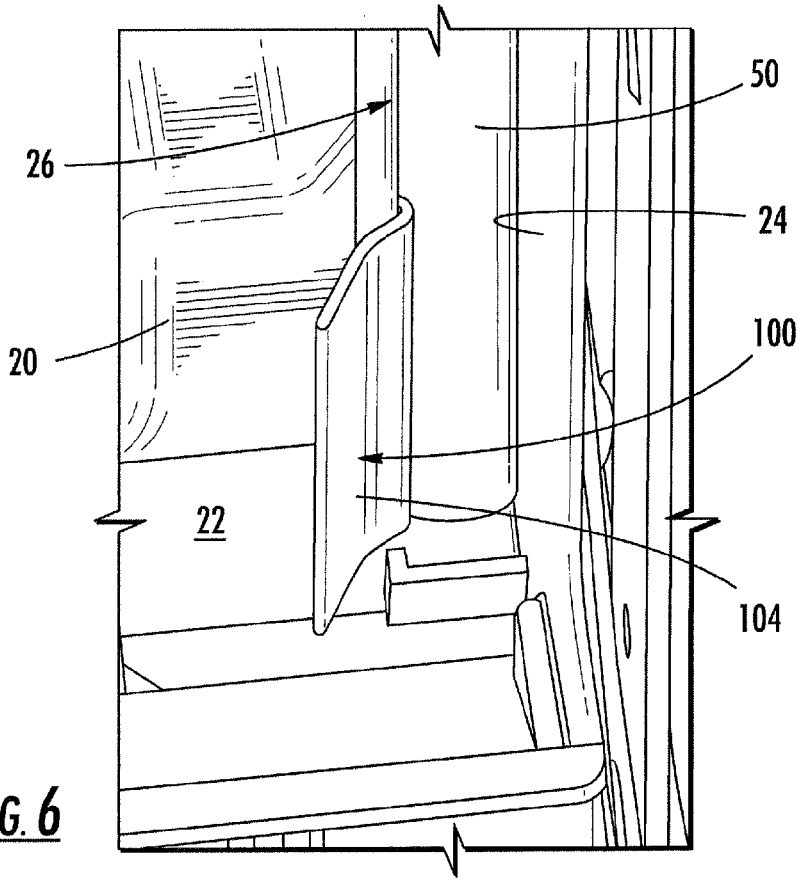
Figure 7:
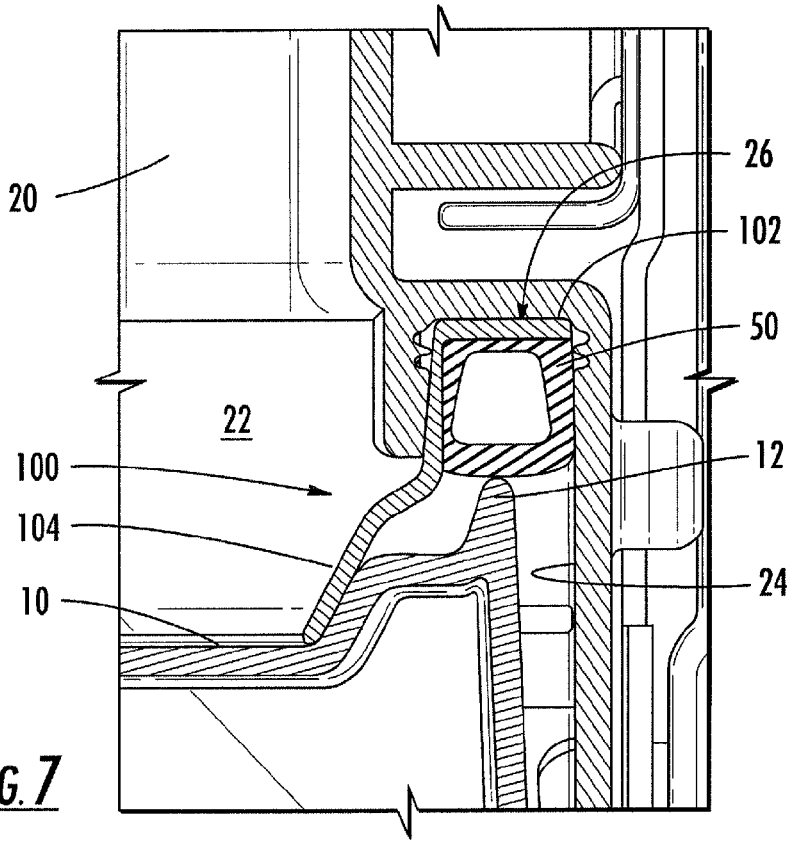
Figure 8:
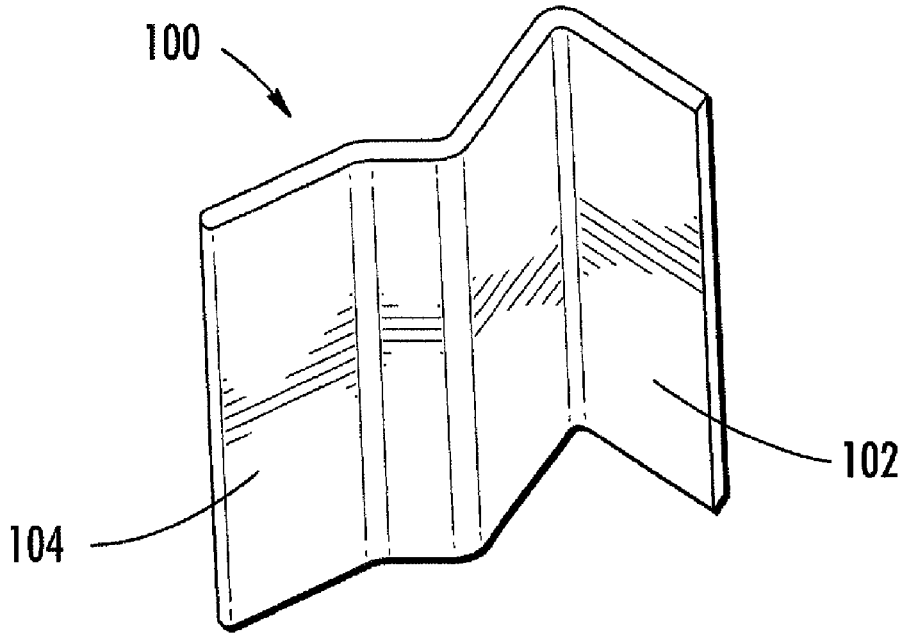
FIG. 8 illustrates a perspective view of a deflector member adapted for implementation into a dishwasher appliance, according to one embodiment of the present invention.
Figure 9:
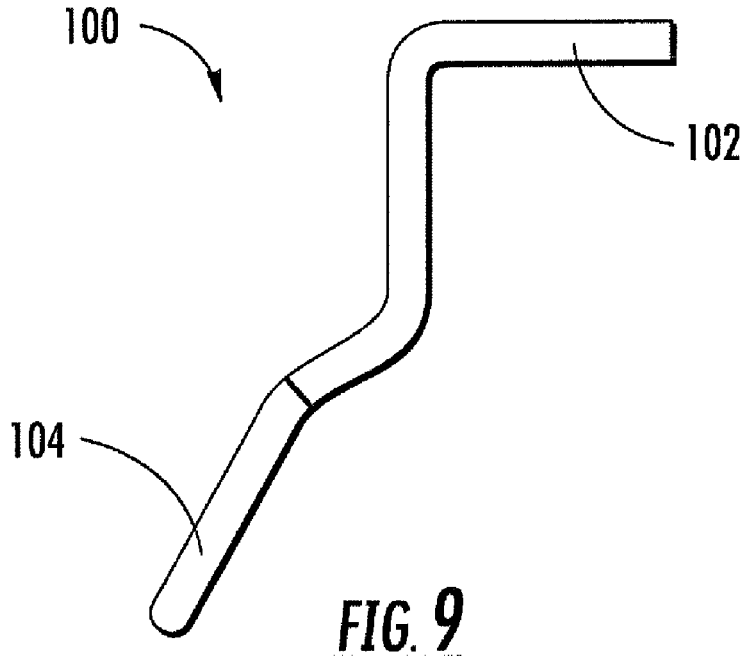
FIG. 9 illustrates a plan view of the deflector member of FIG. 8, according to one embodiment of the present invention.
Figure 10:
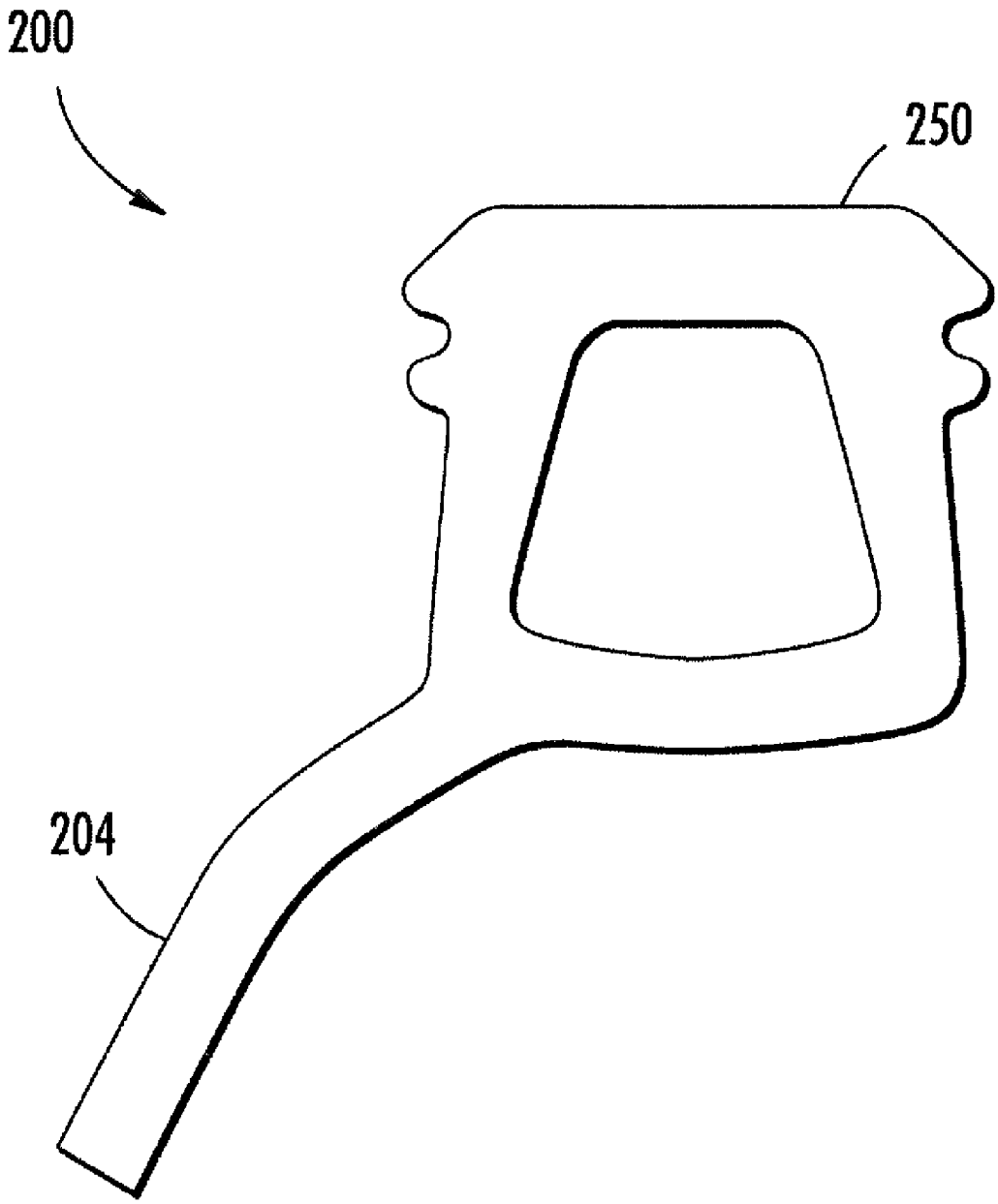
FIG. 10 illustrates a plan view of a deflector member adapted for implementation into a dishwasher appliance, according to another embodiment of the present invention.
Figure 11:
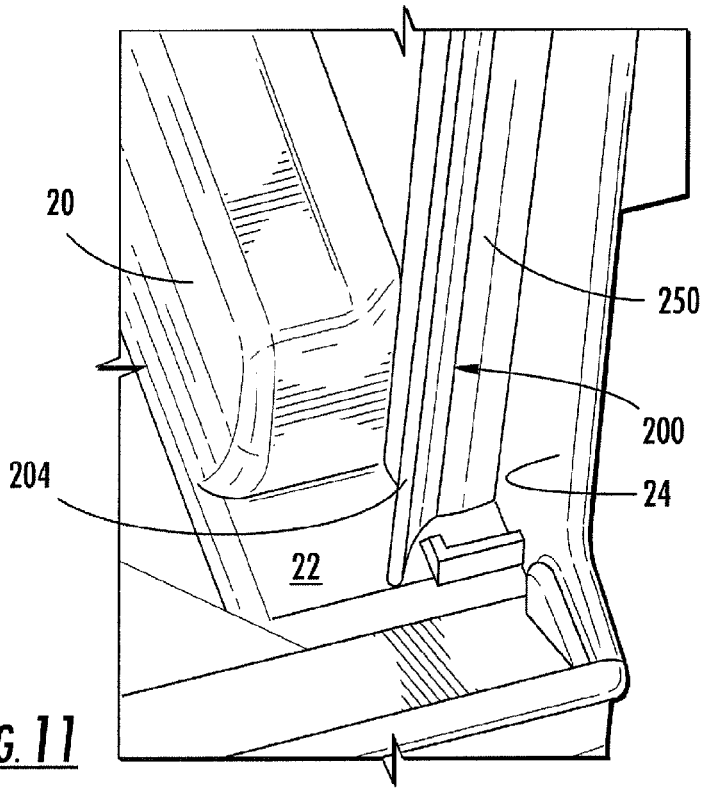
Figure 12:
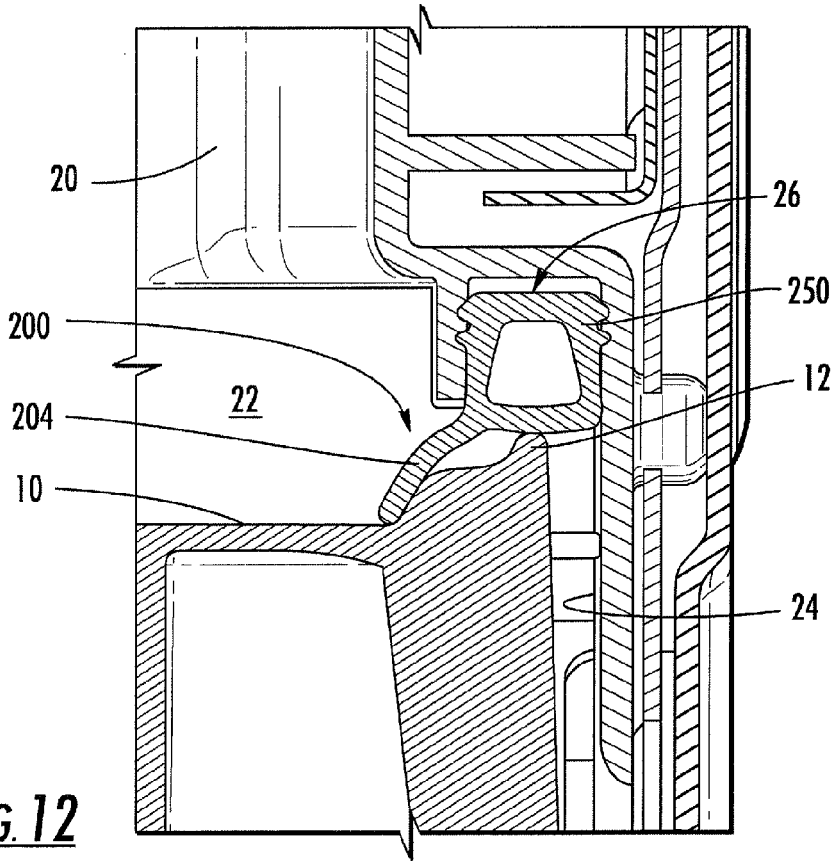

FIG. 11 schematically illustrates a perspective view of a tub portion of a dishwasher appliance implementing the deflector member of FIG. 10, according to one embodiment of the present invention; and FIG. 12 schematically illustrates a cross-sectional plan view of a of a dishwasher appliance implementing the deflector member of FIG. 10, according to one embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As shown in FIGS. 3-7 and 12-13, a dishwasher appliance typically includes a door 10 pivotable about the lower end of a tub 20, adjacent to a substantially vertical front opening defined by the tub 20, wherein a user may selectively pivot the door 10 between a substantially vertical "closed" position (in which the door 10 covers the front opening) and a substantially horizontal "open" position, where the door 10 is generally parallel with a supporting floor surface (i.e. perpendicular to the front opening). The door 10 in the open position thus allows one or more racks to be moved into and out of the tub so as to permit loading and unloading of dishware when the door 10 of the dishwasher appliance is in an "open" position. Door 10 may be hinged or otherwise engaged with the tub so as to be capable of pivoting about the lower end of the tub 20. The tub 20 may be comprised of a plurality of supporting walls that define the front opening, wherein such walls may be, in some instances, integral with one another. A gasket member 50 may be provided for aiding in sealing the door 10 with the tub 20 about the front opening, wherein the gasket member 50 may be formed or otherwise engaged about the front opening of the tub 20. For example, the front opening may be defined by a pair of opposing and substantially vertical sidewalls 24, wherein the portion of the sidewalls 24 proximate to the front opening may define a channel 26 for receiving the gasket member 50 (which may include ribs to provide an interference fit with the gasket member 50 within the channel 26), wherein the channel 26 may extend approximately the entire height of the sidewalls 24.

The gasket member 50 may be received within the channel 26 so as to engage a side portion or flange 12 of door 10 to form a water-tight seal with the tub 20 during operation of the dishwasher. In some instances, the gasket member 50 may comprise a thermoplastic material configured to resiliently contact the flange 12 of door 10. In some instances, though the gasket member 50 is shown in engagement with the tub 20, one skilled in the art will appreciate that the door 10 may be alternatively configured to receive the gasket member 50, wherein the gasket member 50 moves with the door 10 as it pivots so as to interface with a portion of the front opening of the tub 20 to form a seal therewith. For example, the door member 10 may include or define channel 26 for receiving the gasket member 50. In any instance, the gasket member 50 may extend along opposing sides of the door 10 and/or the tub 20, about the front opening of the tub 20, so as to interact with the door 10 and/or tub 20 to form the seal/interface between the door 10 and the tub 20 about the front opening.

FIGS. 1-4 schematically illustrate a prior art sealing arrangement between the door 10 and the tub 20 of a dishwasher during operation thereof. Such a prior art apparatus comprises a laterally-extending elongate wiper member 40 that is installed on the door 10 of the dishwasher. The wiper member 40 comprises a main body 42 and a pair of winged portions 44 attached on opposing ends of the main body 42 by, for example, ultrasonic welding. Both the main body 42 and the winged portions 44 consist of a hard plastic portion to provide structure and soft portions 46A, 46B (for example, comprised of "Sanoprene™") to aid in sealing. Such components are typically manufactured using a co-extrusion process. When the door 10 is installed on the tub 20, the majority of paths for the water to exit the tub 20 (i.e., leak) are blocked by the interface between the door 10 and the gasket member 50. The lower soft sealing portion 46A of the main body 42 of the wiper member 40 seals against the bottom surface 22 of the tub 20, preventing the water from escaping between the wiper member 40 and the tub 20. However, if water from the water jets of a spray arm (used to spray water onto the dishware disposed within the tub) impinges on or is otherwise directed toward the corner defined by the tub 20/door 10 interface, the water may move along the face of the wiper member 40 and can escape through the interface between the ends of the winged portions 44/sealing portion 46B of the wiper member 40 and the corresponding side wall 24 of the tub 20. The winged portions 44 at the opposing ends of the wiper member 40 are generally intended to prevent this leakage at the forward corners of the tub 20. However, such measures may result in additional costs related to attaching the winged portions 44 to the main body 42. Further, such apparatuses may also be sensitive to the proper location of the door 10 in that, with normal variation associated with manufacturing, the dishwasher may experience leakage proximate to the forward corners of the tub 20 if the winged portions 44 happen to be misaligned. Also, the addition of the winged portions 44 to the wiper member 40 may result in difficulties assembling the door 10 to the tub 20, thereby increasing manufacturing costs and time, and possibly decreasing the effectiveness of the wiper member 40.

Accordingly, embodiments of the present invention are particularly configured to prevent water from escaping/leaking from between the door and the tub of a dishwasher during operation thereof, so as to reduce the risk of water damage due to such leaks and to reduce or minimize service calls that result therefrom, while also improving the ease of manufacture thereof by minimizing variances in assembling the components of a dishwasher appliance. Embodiments of the present invention provide a flange member configured to engage at least one of the tub and door of the dishwasher so as to prevent water being sprayed from at least one spray arm disposed in the tub portion from impinging on a seal formed between the tub and the door during operation of the dishwasher.

FIGS. 5-9 schematically illustrate a flange member for a dishwasher according to one embodiment of the present invention, the flange member being generally indicated by the numeral 100. Such a flange member 100 may include a main body portion 102 configured to be received within, or otherwise at least partially conform to, the channel 26 of the tub 20. For example, the main body portion 102 may be configured to fit within the channel 26. That is, portions of the main body portion 102 may form a substantially right-angled corner portion configured to conformally engage a corner of the channel 26 (e.g., along side wall 91 and rear wall 92 of the channel 26). In other instances, the main body portion 102 may be configured to conform to the entire shape of the channel 26 (e.g., a substantially U-shaped portion corresponding to the shape of the channel). In other embodiments, the channel 26 may be formed on or otherwise defined by the door member 10. In any instance, the main body portion 102 interacts with and is secured in the portion of the tub 20 defining the channel 26. The flange 100 may, in some instances, extend from the bottom surface 22 of the tub 20 to the top portion (not shown) thereof. In other instances, the flange 100 may partially extend from the bottom surface 22 along the sidewall 24, without extending to the top portion of the tub 20.

The main body portion 102 may be constructed of any suitable material and may be comprised of, for example, a hardened polymer material so as to provide structural support, rigidity, and robustness to the deflector member 100. The main body portion 102 may be positioned in the channel 26 of the tub 20, and a gasket member 50 may then be received within the channel 26. In one embodiment, the gasket member 50 may be inserted into the channel 26 such that the main body portion 102 is disposed between the channel 26 and the gasket member 50, thereby securing the flange member 100 with respect to the channel 26 (i.e., both by securing the flange 100 in the channel 26 and by preventing movement of the flange 100 along the channel 26). For instance, the gasket member 50 may be secured in channel 26 by an interference fit therebetween, which, in some instance, also secures the main body portion 102 within channel 26 by an interference fit.

In some embodiments, the flange member 100 may also include a wing portion 104 extending laterally outwardly from the main body portion 102 away from the channel 26 in a cantilevered manner. For example, the wing portion 104 may extend or cantilever from the main body portion 102 at an angle such that the wing portion 104 contacts the door 10 at an acute angle. Although, in some instances, the wing portion 104 may extend/cantilever from the main body portion 102 at a right angle when necessary or desirable. When the door 10 is closed with respect to the tub 20, the wing portion 104 extends toward the door 10 (or toward the tub 20 if engaged with and secured to the door 10), in some instances, to interface therewith. Further, in some instances, a seal may be formed therebetween. The wing portion 104 of the flange 100 thus essentially separates the interior of the tub 20 from the seal formed between the tub 20 and the door 10 via the gasket member 50. As such, water sprayed by the spray arms, which ends up being deflected or otherwise directed to the tub 20/door 10 interface involving the gasket member 50, ends up being prevented by the wing portion 104 from reaching the sealed interface. As such, any water stopped by the wing portion 104 is diverted back into the tub 20. That is, the wing portion 104 is secured in a particular position with the door 10 in the closed position, so as to extend between the tub 20 and the door 10 about the opposing sides to deflect water away from the seal member and back into the tub 20. In some instances, the wing portion 104 may extend from the bottom surface 22 of the tub 20 to the top portion thereof or, in other embodiments, extend only partially therebetween. In other instances, the flange member 100 extends between the tub 20 and the door member 10 at least about the lower end of the tub 20.

In some embodiments, the wing portion 104 may be comprised of any suitable material and, in some instances, may be comprised of a soft polymer material configured to resiliently interact with the door 10 and the tub 20. In some instances, the flange member 100 may be co-extruded, with the main body portion 102 comprising a hardened plastic material to provide structure and the wing portion 104 comprising a soft plastic material (e.g., "Sanoprene™") to aid in sealing. In such instances, the flange member 100 may be cost-effectively extruded rather than injection molded (a more costly process), and does not require a locating feature associated with the tub for implementing the flange member 100 (thereby reducing tooling cost and time to implementation).

The flange member 100 may be configured for refitting into existing units or for implementation into new dishwasher units. In some instances, the flange member 100 may be used on both sides of the front opening of the tub 20. In instances where the flange member 100 is positioned on both sides, the opposing flange members 100 cooperate between the tub 20 and the door 10 about each opposed side of the front opening.

As shown in FIGS. 11-13, other embodiments of the present invention may provide a flange member 200 for deflecting water away from the seal between the door 10 and the tub 20, proximate to the front opening, during operation of the dishwasher appliance. The flange member 200 may comprise a gasket member 250 and a wing portion 204 extending outwardly in a cantilevered manner from the gasket member 250. In some instances, the gasket member 250 and the wing portion 204 are integrally formed. The gasket member 250 may be received and secured within the channel 26, which may be formed on or defined by the door 10 or the tub 20. As such, the gasket member 250 may be positioned with respect to the channel 26 to interact with the flange 12 of the door 10 to form a seal therebetween, while the wing portion 204 extends between the door 10 and the tub 20 about the opposing sides to deflect water away from the gasket member 250 forming the seal between the tub 20 and the door 10, via the flange 12.

The gasket member 250 and the wing portion 204 may be comprised of any suitable material or combinations of materials and, in some instances, may be comprised of the same material such that the entire flange member 200 may be integrally extruded. For example, the flange member 200 may be extruded from a thermoplastic elastomer material, such as rubber. In some embodiments, the flange member 200 may be comprised of a soft polymer material capable of interacting with the door 10 or flange 12 associated therewith to form a seal therebetween.

In some embodiments, the flange member 100 or 200 may extend about the front opening so as to extend along both opposing sides thereof. In such embodiments, the flange member 100 or 200 may extend about the top or bottom of the front opening, in addition to the opposing sides, defined by the tub 20 so as extend about at least three sides defining the front opening. In any instance, the flange member 100 or 200 may be configured to cooperate with the gasket member, tub, and/or door to deflect water away from the sealing interface between the door 10 and the tub 20.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher appliance comprising:

a tub portion defining a front opening for receiving dishware therethrough, the front opening having opposing sides;

a door member pivotably engaged with a lower end of the tub portion for selectively allowing access to the tub portion through the front opening;

a gasket member configured to be received in operable engagement with one of the tub portion and the door member along the opposing sides of the front opening, and the gasket member being configured to interact with the other of the tub portion and the door member to form a seal therebetween when the door member is pivoted to a closed position with respect to the front opening;

at least one flange member extending at least partially along at least one of the opposing sides of the front opening of the tub portion and configured to interact with the gasket member, the tub portion, and the door member, the at least one flange member further being cantilevered with respect to the gasket member such that upon closing of the door member, the at least one flange member is configured to separate the tub portion from the seal and deflect washing fluid within the tub portion away from the gasket member; and a gasket-receiving channel defined in the tub portion along each of the opposing sides, the gasket-receiving channel configured to receive the gasket member and the at least one flange member therein such that the at least one flange member is disposed between the gasket member and the gasket-receiving channel and surrounds the gasket member within the gasket-receiving channel so as to secure the at least one flange member therein, wherein the flange member extends outwardly from the gasket-receiving channel toward the door member to separate the tub portion from the gasket member and prevent fluid communication between the gasket member and the tub portion.

2. A dishwasher appliance according to claim 1, wherein the at least one flange member is operably engaged with the gasket member and extends from the tub portion to the door member.

3. A dishwasher appliance according to claim 1, wherein the at least one flange member comprises a thermoplastic elastomer material.

4. A dishwasher appliance according to claim 1, wherein the at least one flange member is at least partially disposed along the opposing sides of the front opening proximate to the lower end of the tub portion.

5. The dishwasher according to claim 1, wherein the gasket-receiving channel comprises at least one side wall and a rear wall, and wherein the at least one flange member is disposed between the gasket member and the at least one side wall and rear wall of the gasket-receiving channel.

6. The dishwasher according to claim 1, wherein the flange member extends outwardly from the gasket-receiving channel toward the door member to separate the tub portion from the entire gasket member.

7. A method of sealing a dishwasher appliance, the dishwasher appliance including a tub portion defining a front opening therethrough into the tub portion, the dishwasher appliance further including a door member pivotably engaged with a lower end of the tub portion for selectively allowing access to the tub portion, at least one of the door member and the tub portion being adapted to receive a gasket member in operable engagement therewith about the front opening, the gasket member extending along opposing sides of one of the door member and the tub portion, about the front opening of the tub portion, and being adapted to interact with the other of the door member and the tub portion to form a seal therebetween, said method comprising:

operably engaging at least one flange member with the gasket member, the at least one flange member extending at least partially along at least one of the opposing sides of the front opening of the tub portion and configured to interact with the gasket member, the tub portion, and the door member, the at least one flange member further being cantilevered with respect to the gasket member such that upon closing of the door member, the at least one flange member is configured to separate the tub portion from the seal and deflect washing fluid within the tub portion away from the gasket member; and wherein operably engaging comprises operably engaging the gasket member and the at least one flange member within a gasket-receiving channel, the gasket-receiving channel defined in the tub portion along each of the opposing sides and receiving the gasket member and the at least one flange member therein such that the at least one flange member is disposed between the gasket member and the gasket-receiving channel and surrounds the gasket member within the gasket-receiving channel so as to secure the flange member therein, wherein the flange member extends outwardly from the gasket-receiving channel toward the door member to separate the tub portion from the gasket member and prevent fluid communication between the gasket member and the tub portion.

8. A method according to claim 7, wherein operably engaging further comprises operably engaging the at least one flange member with the gasket member such that the at least one flange member extends from the tub portion to the door member.

9. A method according to claim 7, wherein operably engaging further comprises operably engaging the at least one flange member at least partially along the opposing sides of the front opening proximate to the lower end of the tub portion.

10. The method according to claim 7, wherein the gasket-receiving channel comprises at least one side wall and a rear wall, and wherein the at least one flange member is disposed between the gasket member and the at least one side wall and rear wall of the gasket-receiving channel.

* * * * *